US009422691B2

(12) United States Patent
Ueta

(10) Patent No.: US 9,422,691 B2
(45) Date of Patent: Aug. 23, 2016

(54) UPPER SLEWING BODY FOR CONSTRUCTION MACHINE

(71) Applicant: KOBELCO CONSTRUCTION MACHINERY CO., LTD., Hiroshima-shi (JP)

(72) Inventor: Toshiro Ueta, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/658,827

(22) Filed: Mar. 16, 2015

(65) Prior Publication Data

US 2015/0267379 A1 Sep. 24, 2015

(30) Foreign Application Priority Data

Mar. 20, 2014 (JP) ..... 2014-058535

(51) Int. Cl.
*E02F 9/12* (2006.01)
*E02F 9/08* (2006.01)
*E02F 9/22* (2006.01)

(52) U.S. Cl.
CPC ..... *E02F 9/123* (2013.01); *E02F 9/0866* (2013.01); *E02F 9/0875* (2013.01); *E02F 9/0883* (2013.01); *E02F 9/121* (2013.01); *E02F 9/2267* (2013.01); *E02F 9/2275* (2013.01)

(58) Field of Classification Search
CPC ..... E02F 9/123; E02F 9/2267; E02F 9/0866; E02F 9/2275; E02F 9/121; E02F 9/0883; E02F 9/0875
See application file for complete search history.

(56) References Cited

U.S. PATENT DOCUMENTS 5,711,095 A * 1/1998 Oda ..... E02F 3/325 180/327
2006/0108309 A1* 5/2006 Sato ..... E02F 3/325 212/232
2010/0038162 A1* 2/2010 Kamiya ..... B01D 53/9431 180/69.6
2012/0067661 A1* 3/2012 Kashu ..... B60K 13/04 180/309
2014/0021781 A1* 1/2014 Satake ..... E02F 9/0858 307/9.1

(Continued)

FOREIGN PATENT DOCUMENTS

JP 11-336122 A 12/1999
JP 2000-54429 2/2000
JP 2000-248583 9/2000

(Continued)

OTHER PUBLICATIONS

Extended European Search Report issued Jul. 24, 2015 in Patent Application No. 15158741.7.

*Primary Examiner* — Darlene P Condra
(74) *Attorney, Agent, or Firm* — Oblon, McClelland, Maier & Neustadt, L.L.P

(57) ABSTRACT

Provided is an upper slewing body allowing elements to be compactly arranged while preventing required length of a hydraulic pipe from increase. The upper slewing body includes an upper frame, an engine, a hydraulic pump coupled thereto, a control valve forward of the engine and rearward of a slewing axis, and a rear tank between the engine and the control valve. The control valve is oblique to a frame lateral direction so as to locate a front end portion thereof forward of an inner end portion thereof. The rear tank has a rear opposition side surface opposed to a rear side surface of the control valve while being oblique to the rear side surface thereto.

8 Claims, 3 Drawing Sheets

(56) References Cited

U.S. PATENT DOCUMENTS

| | | | | |
|---|---|---|---|---|
| 2014/0186151 | A1* | 7/2014 | Ootsuka | E02F 9/0833 414/685 |
| 2014/0326529 | A1* | 11/2014 | Noguchi | F02D 41/222 180/309 |

FOREIGN PATENT DOCUMENTS

| | | | |
|---|---|---|---|
| JP | 2005-61086 | A | 3/2005 |
| JP | 2005-171722 | A | 6/2005 |
| KR | 2000-0057072 | A | 9/2000 |

* cited by examiner

UPPER SLEWING BODY FOR CONSTRUCTION MACHINE

TECHNICAL FIELD

The present invention relates to an upper slewing body for a construction machine.

BACKGROUND ART

Upper slewing bodies for a construction machine described in Japanese Unexamined Patent Publication Nos. 2000-54429 and 2000-248583 have been known. FIG. 4 in Japanese Unexamined Patent Publication No. 2000-54429 depicts an upper slewing body which includes an upper frame and a control valve provided on the upper frame, wherein the control valve is oriented obliquely to a lateral direction of the upper frame. Japanese Unexamined Patent Publication No. 2000-248583 describes a slewing hydraulically-driven working machine which includes a hydraulic pump, an oil tank, and an operation valve, the operation valve being obliquely disposed laterally and forward or rearward of the center of slewing. Furthermore, Japanese Unexamined Patent Publication No. 2000-248583 discloses, in the paragraph [0010] thereof, that the disposition of the operation valve allows each of pipes to be shortened to minimize a possible pressure loss.

Such an upper slewing body includes an upper frame, on which an engine as a driving source for the hydraulic pump and the like is mounted, in addition to the hydraulic pump, the control valve connected to the hydraulic pump, and the tank as described above. For such an upper slewing body, it is desirable to compactly arrange the elements to be mounted on the upper frame with a shortened hydraulic pipe connecting the hydraulic pump and the control valve together.

SUMMARY OF INVENTION

An object of the present invention is to provide an upper slewing body including an upper frame, an engine, a hydraulic pump coupled to the engine, a control valve connected to the hydraulic pump via a hydraulic pipe, and a tank, the upper slewing body allowing the elements to be compactly arranged on the upper frame while suppressing an increase in the required length of the hydraulic pipe. Provided is an upper slewing body mounted on a lower traveling body of a construction machine, the upper slewing body including: an upper frame mounted on the lower traveling body so as to be able to be slewed around a slewing axis; an engine mounted in the upper frame at a position rearward of the slewing axis in a frame front-rear direction that is a front-rear direction of the upper frame; a hydraulic pump coupled to one of opposite end portions of the engine in a frame lateral direction to be driven by the engine, the frame lateral direction being a lateral direction of the upper frame; a control valve mounted on the upper frame at a position rearward of the slewing axis and forward of the engine in the frame front-rear direction; a hydraulic pipe interconnecting the hydraulic pump and the control valve; and a rear tank mounted on the upper frame at a position between the engine and the control valve with respect to the frame front-rear direction. The control valve has an inner end portion and an outer end portion which are two opposite end portions in the frame lateral direction, the inner end portion being closer to the slewing axis than the outer end portion. The control valve is disposed so as to locate the outer end portion on the same side as the hydraulic pump, relative to the slewing axis, in the frame lateral direction. The control valve is mounted on the upper frame obliquely to the frame lateral direction so as to locate the outer end portion rearward of the inner end portion in the frame front-rear direction. The hydraulic pipe connects the hydraulic pump to a connection portion of the control valve, the connection portion being closer to the outer end portion than the inner end portion. The rear tank includes an overlap portion overlapping the control valve as viewed in the frame front-rear direction. The overlap portion has a rear opposition side surface oblique to the frame lateral direction in the same direction as a direction in which a rear side surface of the control valve is oblique, the rear opposition side surface being opposed to the rear side surface.

DESCRIPTION OF EMBODIMENTS

There will be described an embodiment of the present invention with reference to the drawings.

Figure 1:
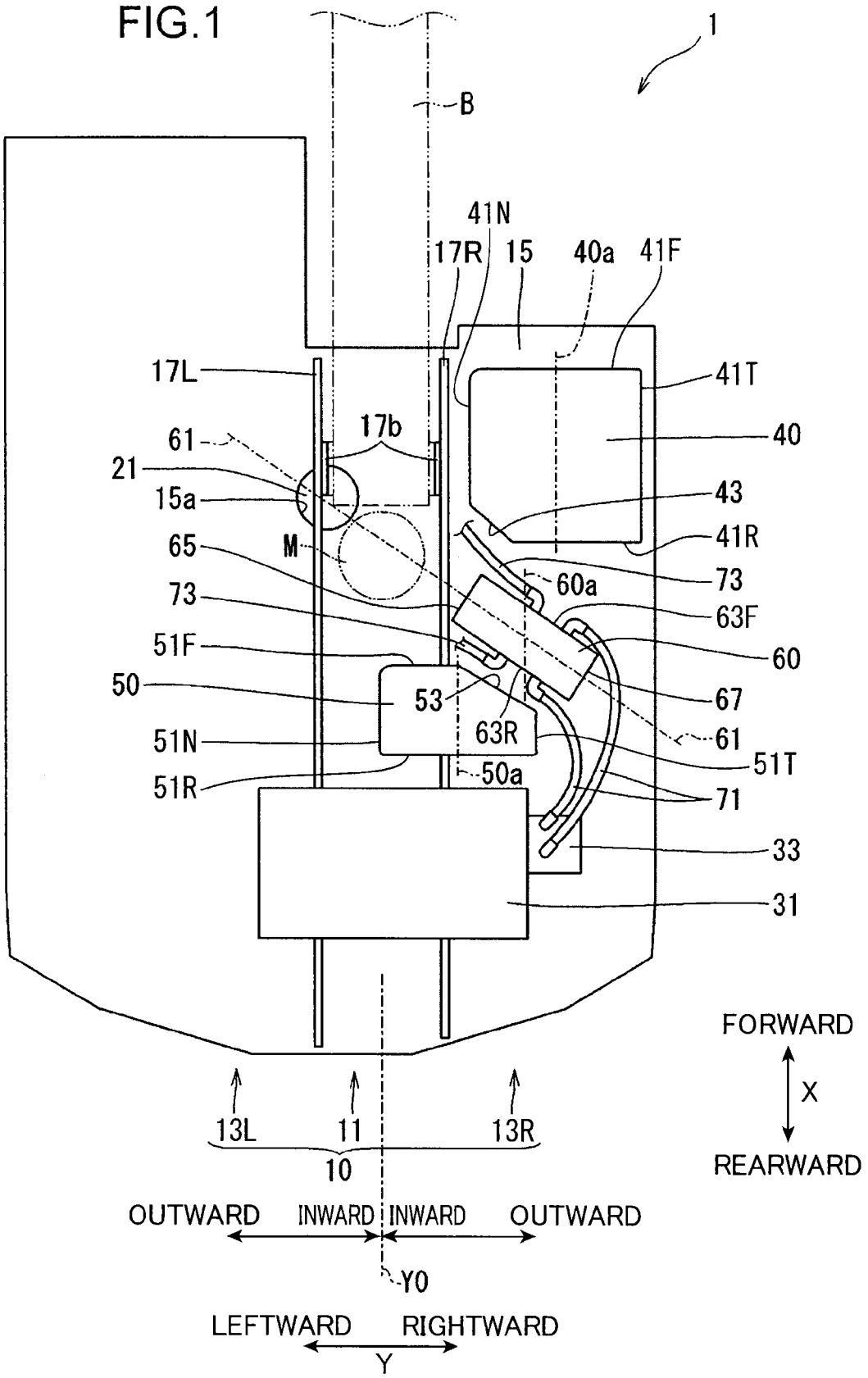
FIG. 1 is a plan view of an upper slewing body according to an embodiment of the present invention.

FIG. 1 depicts an upper slewing body 1 according to the embodiment. The upper slewing body 1 is a component of a construction machine. The construction machine includes the upper slewing body 1, a lower traveling body not depicted in the drawings, and an attachment with a boom B. The upper slewing body 1 is mounted on the lower traveling body so as to able to be slewed, and the attachment is attached to the upper slewing body 1. The construction machine is, for example, an excavator. The excavator may be, for example, a hydraulic excavator or a hybrid excavator. The construction machine according to the present invention is not limited to the excavator.

The upper slewing body 1 includes: an upper frame 10 having a slewing center portion 21; an engine 31; a hydraulic pump 33 coupled to the engine 31; a fuel tank 40 as a front tank; a hydraulic fluid tank 50 as a rear tank; a control valve 60 connected to the hydraulic pump 33; and hydraulic pipes including hydraulic hoses 71 and 73.

The upper frame 10, namely, a slewing frame, is a structure mounted on the lower traveling body so as to be able to be slewed over the lower traveling body around a slewing axis included in the slewing center portion 21. On the upper frame 10 are mounted the engine 31, the hydraulic pump 33, the hydraulic fluid tank 50, the fuel tank 40, the control valve 60, and the like. The upper frame 10 includes a bottom portion 15, a right vertical plate 17R and a left vertical plate 17L. The upper frame 10 is partitioned into a plurality of regions, namely, a center section 11, a left side deck 13R, and a right side deck 13L.

Figure 2:
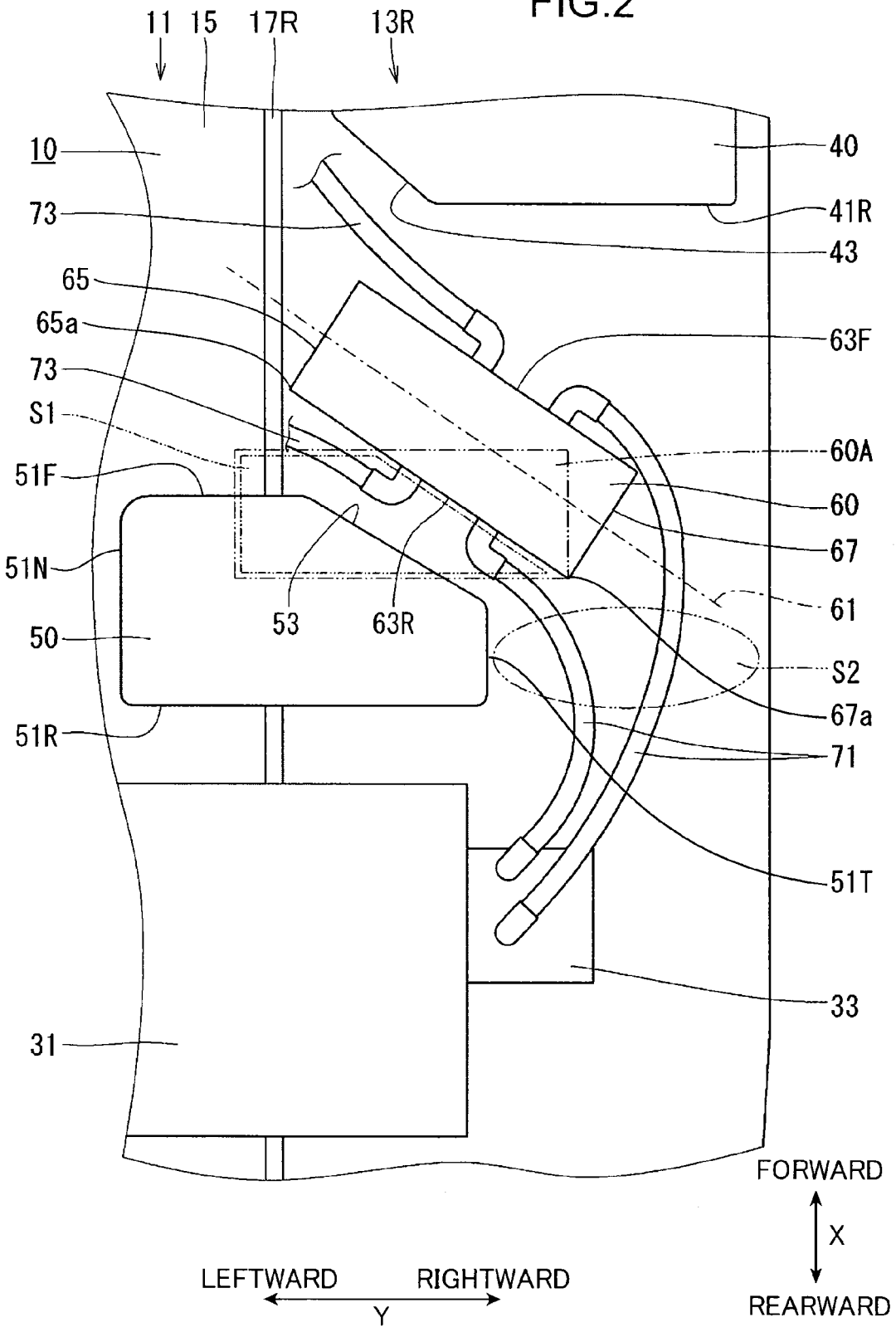
FIG. 2 is an enlarged plan view of a control valve and a peripheral region thereof in the upper slewing body.

The upper frame 10 has a frame front-rear direction that is a front-rear direction indicated by arrow X in FIG. 2 and a frame lateral direction that is a lateral direction indicated by arrow Y in FIG. 2. The frame lateral direction is orthogonal to the frame front-rear direction. In the present specification, "A is forward (rearward) of B" means that A is located forward (rearward) of B in the frame front-rear direction as viewed in the frame lateral direction, not involving requirement for overlap of A and B as viewed in the frame front-rear direction.

The center section 11 is a central region of the upper frame 10 with respect to the frame lateral direction. The right side deck 13R and the left side deck 13L are respective regions on right and left sides of the center section 11.

The bottom portion 15 is a bottom portion, that is, a lower portion, of the upper frame 10. In other words, the bottom portion 15 is a bottom portion shared by the center section 11 and the right and left side decks 13R and 13L. The bottom portion 15 is shaped like a plate or substantially like a plate. The bottom portion 15 has a slewing center hole 15*a*.

The right and left vertical plates 17R and 17L are fixed to the bottom portion 15, projecting upward beyond the bottom portion 15. The right and left vertical plates 17R and 17L extend in the frame front-rear direction while spaced in the frame lateral direction. The right and left vertical plates 17R and 17L are disposed in a central portion of the upper frame 10 with respect to the frame lateral direction. The right vertical plate 17R is located on a boundary between the center section 11 and the right side deck 13R, and the left vertical plate 17L is located on a boundary between the center section 11 and the left side deck 13L. The right and left vertical plates 17R and 17L extend from a front portion to a left portion of the upper frame 10.

Each of the right and left vertical plates 17R and 17L has a boom support portion 17*b*. The boom support portion 17*b* is a portion supporting a basal end of the boom B, namely, a boom foot, having a mounting hole. Each boom support portion 17*b* is located adjacent to the slewing center portion 21. The boom support portions 17*b* are located adjacent to respective front portions of the right and left vertical plates 17R and 17L, respectively.

The slewing center portion 21 is a portion including the slewing axis, which is an axis around which the upper frame 10 is slewed relative to the lower traveling body. Specifically, the slewing center portion 21 is a portion including the slewing axis and a peripheral region thereof. The slewing center portion 21 includes the slewing center hole 15*a*, the slewing axis passing through the center of the slewing center hole 15*a*. In the slewing center hole 15*a* is provided a swivel joint not depicted in the drawings. The swivel joint is a joint which joins a hydraulic pipe in the upper slewing body 1 and a hydraulic pipe in the lower traveling body to each other. The slewing center portion 21 is located forward of the hydraulic fluid tank 50 and rearward of the control valve 60. The slewing center portion 21 is located forward of a central portion of the center section 11 with respect to the frame front-rear direction. The slewing center portion 21 is adjacent to a front portion of the center section 11. The slewing center portion 21 is positioned further toward the left side than the hydraulic fluid tank 50 and the control valve 60. The slewing center portion 21 may be laid across the center section 11 and the right or left side deck 13R or 13L or may be entirely laid within the center section 11.

The engine 31 is a power source for the construction machine. The engine 31 is disposed in a rear portion of the upper frame 10 with respect to the front-rear direction of the frame. The engine 31 is disposed, for example, in a central portion of the upper frame 10 with respect to the frame lateral direction. The engine 31 has a drive shaft not depicted in the drawings, namely, an output shaft.

The hydraulic pump 33 is driven by the engine 31 to discharge hydraulic fluid. The hydraulic fluid discharged by the hydraulic pump 33 is fed to actuators including a slewing motor M in the construction machine as described below, to thereby activate the actuator. The hydraulic pump 33 is coupled to the drive shaft of the engine 31. The hydraulic pump 33 is coupled to one end portion of the engine 31 in the frame lateral direction. The hydraulic pump 33 according to the present embodiment is coupled to a right end portion of the engine 31, while the hydraulic pump according to the present invention may be coupled to a left end portion of the engine.

The control valve 60 is disposed at a position forward of the engine 31 and the hydraulic pump 33 with respect to the frame front-rear direction. The hydraulic fluid tank 50 as the rear tank is disposed rearward of the control valve 60 and forward of the engine 31, that is, between the control valve 60 and the engine 31, with respect to the frame front-rear direction. The fuel tank 40 as the front tank is disposed forward of the control valve 60 with respect to the frame front-rear direction.

The control valve 60 is a valve that controls the flow rate of the hydraulic fluid fed from the hydraulic pump 33 to the actuator and the direction of the feeding. The control valve 60 is disposed rearward of the slewing axis in the slewing center portion 21, with respect to the frame front-rear direction. The control valve 60 is disposed between the hydraulic fluid tank 50 and the fuel tank 40 with respect to the frame front-rear direction. The control valve 60 is disposed, for example, just rearward of the fuel tank 40. Although not depicted in the drawings, at least a part of the control valve 60 may be positioned forward of a rear portion of the fuel tank 40. The control valve 60 is disposed adjacent to the fuel tank 40. The control valve 60 is disposed, for example, forward of and in front of the engine 31, that is, aligned with the engine 31 in the frame front-rear direction. The control valve 60 is disposed, for example, forward of and in front of the hydraulic fluid tank 50, that is, aligned with the engine 31 in the frame front-rear direction. At least a part of the control valve 60 is located forward of the front side of the hydraulic fluid tank 50. The control valve 60 is adjacent to the hydraulic fluid tank 50.

The control valve 60 has a shape having a longitudinal direction as viewed from above, for example, a general rectangle. The control valve 60 has a plan-view center axis 61. The control valve 60 has a plurality of side surfaces each facing in the horizontal direction. The plurality of side surfaces include a front side surface 63F, a rear side surface 63R, an inner end surface 65, and an outer end surface 67.

The plan-view center line 61 is a horizontal center line extending in the longitudinal direction of the control valve 60 as viewed from above.

The front side surface 63F and the rear side surface 63R are flat surfaces or generally flat surfaces orthogonal to the horizontal direction and parallel to the plan-view center axis 61. The front side surface 63F and the rear side surface 63R face forward and rearward, respectively, with respect to the frame front-rear direction.

The inner end surface 65 and the outer end surface 67 are respective end surfaces in two opposite ends of the control valve 60 in a direction along the plan-view center axis 61, that is, the longitudinal direction of the control valve 60, each being orthogonal to the plan-view center axis 61. The inner end surface 65 is a surface of the control valve 60 in an inner end thereof with respect to the frame lateral direction, in other words, at the end close to the slewing axis, in the present embodiment, a surface of the control valve 60 in a left end thereof. The outer end surface 67 is a surface of the control valve 60 in an outer end thereof with respect to the frame lateral direction, in other words, in an end thereof that is far from the slewing axis, in the present embodiment, a surface of the control valve 60 at a right end thereof. Thus, the inner end surface 65 is closer to the slewing center portion 21 than the outer end surface 67 with respect to the frame lateral direction.

The hydraulic hoses 71 and 73 are hydraulic pipes through which the hydraulic fluid is flowed among hydraulic apparatuses, each formed of a hose (high-pressure hoses) capable of being curved and bent. The hydraulic hoses 71 and 73 are connected to the front side surface 63F and rear end surface 63R of the control valve 60, respectively. The hydraulic hoses 71 and 73 may be, alternatively, connected to any of the inner end surface 65, the outer end surface 67, and an upper surface of the control valve 60.

The hydraulic hoses 71 connect the hydraulic pump 33 to the control valve 60. The hydraulic hoses 71 are delivery hoses which guide hydraulic fluid discharged by the hydraulic pump 33 to the control valve 60. The hydraulic hoses 71 pass through a space S2 (FIG. 2) on the outer side of the hydraulic fluid tank 50 with respect to the frame lateral direction. Preferably, the control valve 60 is located so as to align an outer end portion thereof with the hydraulic pump 33 in the frame front-rear direction, and the hydraulic hoses 71 are routed so as to connect the hydraulic pump 33 to a connection portion of the control valve 60, the connection portion being one closer to the outer end portion than to an inner end portion of the control valve 60, namely, a right portion of the control valve 60.

The number of hydraulic hoses 71 is permitted to be any one. In FIG. 1, routed are two hydraulic hoses 71 which are connected to the front side surface 63F and rear side surface 63R of the control valve 60, respectively. Respective positions of the hydraulic hoses 71 on the control valve 60 are closer to the outer end surface 67 than to the inner end surface 65.

The plurality of hydraulic hoses 73 connect the control valve 60 to the plurality of actuators. FIG. 1 depicts only two of the hydraulic hoses 73. The plurality of actuators includes a plurality of hydraulic cylinders and a plurality of hydraulic motors. The plurality of hydraulic motors include the slewing motor M, that is, a motor for slewing the upper slewing body 1 relatively to the lower traveling body, and a traveling motor, that is, a motor for causing the lower traveling body to travel. The plurality of hydraulic cylinders include a boom cylinder for raising and lowering a boom B, an arm cylinder for causing an arm to make a rotational movement, and a bucket cylinder for causing an bucket to make a rotational movement.

The hydraulic hoses 73 are routed inward with respect to the frame lateral direction, that is, leftward, from the control valve 60 (toward the center section 11). In other words, the hydraulic hoses 73 are routed so as to extend from the control valve 60 in a direction of approaching the slewing axis. For example, one of the hydraulic hoses 73 that is to be connected to the boom cylinder is routed under the boom B and through the neighborhood of the slewing center portion 21. The hydraulic hose 73 to be connected to the arm cylinder and the bucket cylinder are routed through the neighborhood of the slewing center portion 21 to a back surface of the boom B. The hydraulic hose 73 to be connected to the slewing motor M is routed through the neighborhood of the slewing center portion 21. The hydraulic hose 73 to be connected to the traveling motor is connected to the swivel joint provided in the slewing center portion 21.

The control valve 60 is disposed so as to reduce (preferably minimize) the required lengths of the hydraulic hose 71 and 73. Reducing required lengths of the hydraulic hoses 71 and 73 decreases the pressure loss in the hydraulic fluid flowing through the hydraulic hoses 71 and 73, thereby allowing energy for driving the hydraulic pump 33 to be reduced. Furthermore, the control valve 60 is disposed so as to facilitate routing of the hydraulic hoses 71 and 73, specifically, as follows.

The control valve 60 is disposed obliquely with respect to the frame lateral direction as viewed from above. Specifically, the control valve 60 is disposed so as to locate the inner end surface 65 of the control valve 60 forward of the outer end surface 67, more specifically, so as to locate a rear end 65*a* of the inner end surface 65 forward of a rear end 67*a* of the outer end surface 67 as depicted in FIG. 2. In the present embodiment, the control valve 60 is disposed so as to make the front side surface 63F and the rear side surface 63R oblique to the frame lateral direction or so as to make the plan-view center axis 61, as viewed from above, oblique to the frame lateral direction (and also to the frame front-rear direction). The plan-view center axis 61, thus, extends obliquely so as to be displaced forward as approaching the inner side of the frame lateral direction from the outer side thereof.

This disposition of the control valve 60 reduces the distance between the hydraulic pump 33 and the outer end portion including the outer end surface 67 of the control valve 60 to thus allow the required lengths of the hydraulic hoses 71 routed between the hydraulic pump 33 and the outer end portion to be reduced.

Besides, the obliquity of the plan-view center axis 61 to the frame lateral direction as described above enables such a space S1 as depicted in FIG. 2 to be created. The space S1 is a region defined as follows. Now is assumed such a position of the control valve 60 that the plan-view center line 61 is parallel to a lateral direction Y as indicated by an alternate long and two short dashes line 60A as shown in FIG. 2. When the control valve 60 is rotated around the rear end 67*a* of the outer end surface 67 from the above assumed position so as to make the plan-view center line 61 oblique to the frame lateral direction, the space S1 is created at an inner side of the rear end 67*a*. In other words, the space S1 is a region occupied by the control valve 60 not yet to be rotated as indicated by the alternate long and two short dashes line 60A. In the space S1, at least a part of the hydraulic fluid tank 50 is disposed.

The control valve 60 is disposed also so as to allow the hydraulic hoses 73 to easily face (in other words, naturally face) the slewing center portion 21, many hydraulic hoses 73 passing through or connected to the slewing center portion 21. Specifically, the control valve 60 is disposed so as to direct the plan-view center line 61 to the slewing center portion 21. As viewed from above, an extension line of the plan-view center line 61 passes through the slewing center portion 21. The extension line passes, for example, through the slewing center hole 15*a* or the swivel joint, or through the slewing axis or the neighborhood thereof. As viewed from above, the plan-view center axis 61 is directed to a region through which the hydraulic hose 73 passes near a boom support portion 17*b*, or to a region peripheral to the region. As viewed from above, the plan-view center axis 61 is directed to the neighborhood of the slewing motor M to which the particular hydraulic hose 73 is connected. In the hydraulic hose 73, the part neighborhood of an end of the hydraulic hose 73, the end being connected to the control valve 60, is disposed parallel to the front and rear side surfaces 63F and 63R and plan-view center axis 61 of the control valve 60.

The hydraulic fluid tank 50 is a container for containing therein the hydraulic fluid fed to the hydraulic pump 33 and the hydraulic fluid returned from the actuator. The hydraulic fluid tank 50 is disposed between the control valve 60 and the engine 31. The hydraulic fluid tank 50 is disposed, for example, forward of and in front of the engine 31, that is, disposed such that at least a part of the hydraulic fluid tank 50 overlaps the engine 31 as viewed in the frame front-rear direction. The hydraulic fluid tank 50 is disposed, for example, forward of and in front of the hydraulic pump 33, that is, disposed such that at least a part of the hydraulic fluid tank 50 overlaps the hydraulic pump 33 as viewed in the frame front-rear direction.

The hydraulic fluid tank 50 is disposed in a space including the space S1. The hydraulic fluid tank 50 according to the present embodiment is disposed over and across the right vertical plate 17R in the frame lateral direction. In other words, the hydraulic fluid tank 50 is disposed across over the center section 11 and the right side deck 13R. Alternatively, the hydraulic fluid tank 50 may be disposed across over both the right and left vertical plates 17R and 17L. The hydraulic fluid tank 50 shown in FIG. 1 has a shape generally like a pentagon as viewed from above; however, the shape may be generally like a triangle, a rectangle, or a polygon with six or more vertices or including a combination of a straight line and a curve.

The hydraulic fluid tank 50 has a plurality of side surfaces. The plurality of side surfaces are surfaces each being orthogonal to the horizontal direction, in other words, flat surfaces or generally flat surfaces directed to the horizontal direction. The plurality of side surfaces include a front side surface 51F facing the front side of the frame front-rear direction, a rear side surface 51B facing the rear side of the frame front-rear direction, an outer side surface 51T facing the right side, i.e., the outer side of the frame lateral direction, an inner side surface 51N facing the left side, i.e., the inner side of the frame lateral direction, and a rear opposition side surface 53. The front side surface 51F and the rear side surface 51R are orthogonal to the frame front-rear direction. The outer side surface 51T and the inner side surface 51N are orthogonal to the frame lateral direction.

The rear opposition side surface 53 is included in a portion of the hydraulic fluid tank 50, the portion being close to the control valve 60, in detail, the portion overlapping the control valve 60 as viewed in the frame front-rear direction. Specifically, the rear opposition side surface 53 is formed in a portion which is an outer end portion and also a front end portion of the hydraulic fluid tank 50. The rear opposition side surface 53 is, thus, interposed between the front side surface 51F and the outer side surface 51T.

The rear opposition side surface 53 is oblique to the frame lateral direction in the same direction as that of the rear side surface 63R of the control valve 60, being opposed to the rear side surface 63R. The rear opposition side surface 53 is opposed to the rear side surface 63R of the control valve 60 while extending along the hydraulic hoses 71 and 73 extending along the rear side surface 63R of the control valve 60. The rear opposition side surface 53 is preferably parallel to the rear side surface 63R of the control valve 60 (in the present embodiment, parallel to the plan-view center axis 61). The hydraulic fluid tank 50 according to the present embodiment, therefore, has a shape in a top plan view, the shape being a remainder of a rectangle from which a specific corner portion thereof has been cut out along the rear opposition side surface 53, the rectangle extending in the frame lateral direction, the specific corner portion being closest to the control valve 60 of four corner portions of the rectangle, that is, the specific corner portion being an outer front portion of the hydraulic fluid tank 50.

The fuel tank 40 is a container for storing therein fuel supplied to the engine 31. The fuel tank 40 is disposed at a position forward of the control valve in the frame front-rear direction, for example, disposed at a position rearward of and in front of the control valve 60 so that the control valve 60 and at least a part of the fuel tank 40 overlap each other as viewed in the frame front-rear direction. The fuel tank 40 is disposed on a front side portion of the right side deck 13R of the upper frame 10. The fuel tank 40 shown in FIG. 1 has a shape in top plan view, the shape being generally like a pentagon; however, the shape may be generally like a triangle, a rectangle, or a polygon with six or more vertices or may include a combination of a straight line and a curve.

The fuel tank 40 has a plurality of side surfaces. The plurality of side surfaces are surfaces each being orthogonal to the horizontal direction, in other words, flat surfaces or generally flat surfaces directed to the horizontal direction. The plurality of side surfaces include a front side surface 41F facing the front side of the frame front-rear direction, a rear side surface 41R facing the rear side of the frame front-rear direction, an outer side surface 41T facing the right side, that is, the outer side of the frame lateral direction, an inner side surface 41N facing the left side, that is, the inner side of the frame lateral direction, and a front opposition side surface 43. The front side surface 41F and the rear side surface 41R are orthogonal to the frame front-rear direction. The outer side surface 41T and the inner side surface 41N are orthogonal to the frame lateral direction.

The front opposition side surface 43 is included in a portion of the fuel tank 40, the portion being close to the control valve 60, in detail, the portion overlapping the control valve 60 as viewed in the frame front-rear direction. Specifically, the front opposition side surface 43 is formed in a portion which is an inner end portion and also a rear end portion of the fuel tank 40. In other words, the front opposition side surface 43 is interposed between the rear side surface 41R and the inner side surface 41T. The front opposition side surface 43 is oblique to the frame lateral direction in the same direction as that of the front side surface 63F of the control valve 60 and opposed to the front side surface 63F. The front opposition side surface 43 is opposed to the front side surface 63F of the control valve 60 while extending along the hydraulic hoses 73 extending along the front side surface 63F of the control valve 60. The front opposition side surface 43 may extend along the hydraulic hoses 71. The front opposition side surface 43 is preferably parallel to the front side surface 63F of the control valve 60 (in the present embodiment, parallel to the plan-view center axis 61). The fuel tank 40 according to the present embodiment, therefore, has a shape in a top plan view, the shape being a remainder of a rectangle from which a specific corner portion thereof has been cut out along the rear opposition side surface 43, the rectangle extending in the frame lateral direction, the specific corner portion being closest to the control valve 60 of four corner portions of the rectangle, that is, the specific corner portion being an inner rear portion of the fuel tank 40.

The control valve 60 is thus interposed between the rear opposition side surface 53 and the front opposition side surface 43.

The rear opposition side surface 53, being opposed to the rear side surface 63R of the control valve 60 while being oblique thereto in the same direction as that in which the rear side surface 63R of the control valve 60 is oblique, allows the space required for aligning the control valve 60 and the hydraulic fluid tank 50 with each other in the frame front-rear direction to be reduced in the dimension in the frame front-rear direction, in spite of the obliquity of the control valve 60.

Moreover, disposing the outer portion of the rear side surface 63R of the control valve 60 rearward of the front end portion of the rear opposition side surface 53 makes the reduction in the space with respect to the frame front-rear direction be more significant. The hydraulic hoses 73 can also be routed so as to extend along the rear opposition side surface 53 (substantially in parallel to the plan-view center axis 61) between the rear side surface 63R and the rear opposition side surface 53.

On the other hand, the hydraulic fluid tank 50 is disposed so as to facilitate routing of the hydraulic hoses 71 in the space S2 on the outer side of the hydraulic fluid tank 50, specifically, disposed as follows.

The hydraulic fluid tank 50 is disposed so as to be offset from the control valve 60 inward with respect to the frame lateral direction. Specifically, as depicted by lines 50*a* and 60*a* in FIG. 1, the center of the hydraulic fluid tank 50 is positioned inward of the center of the control valve 60 with respect to the frame lateral direction. The line 50*a* is a straight line extending in the frame front-rear direction through a midpoint of a segment joining the inner side surface 51N and outer side surface 51T of the hydraulic fluid tank 50 to each other in the frame lateral direction. The line 60*a* is a straight line extending in the frame front-rear direction through a midpoint of a segment joining the inner end surface 65 and outer side surface 67 of the control valve 60 to each other along the plan-view center axis 61.

Furthermore, the hydraulic fluid tank 50 is disposed so that at least a part thereof protrudes inward beyond the inner end surface 65 of the control valve 60 in the frame lateral direction. Preferably, the outer side surface 51T of the hydraulic fluid tank 50 is located inward of the outer end surface 67 of the control valve 60. In other words, the hydraulic fluid tank 50 does not protrude outward beyond the outer end surface 67. More preferably, the outer side surface 51T of the hydraulic fluid tank 50 is located inward of the outer end portion of the rear side surface 63R of the control valve 60.

On the other hand, the front opposition side surface 43 of the fuel tank 40, opposed to the front side surface 63F of the control valve 60 while being oblique in the same direction as that in which the front side surface 63F is oblique as described above, allows the space required for aligning the control valve 60 and the fuel tank 40 with each other in the frame front-rear direction to be reduced in the dimension in the frame front-rear direction, in spite of the obliquity of the control valve 60. The hydraulic hoses 73 can also be routed so as to extend along the front opposition side surface 43 (substantially in parallel to the plan-view center axis 61) between the front side surface 63F and the front opposition side surface 43.

Figure 3A:
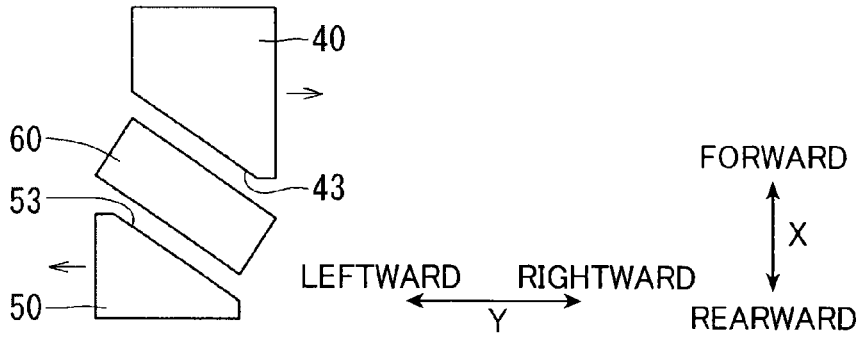
FIG. 3A, FIG. 3B, and FIG. 3C are plan views depicting respective variations of disposition of the control valve and tanks positioned forward and rearward of the control valve in the upper slewing body.
Figure 3B:
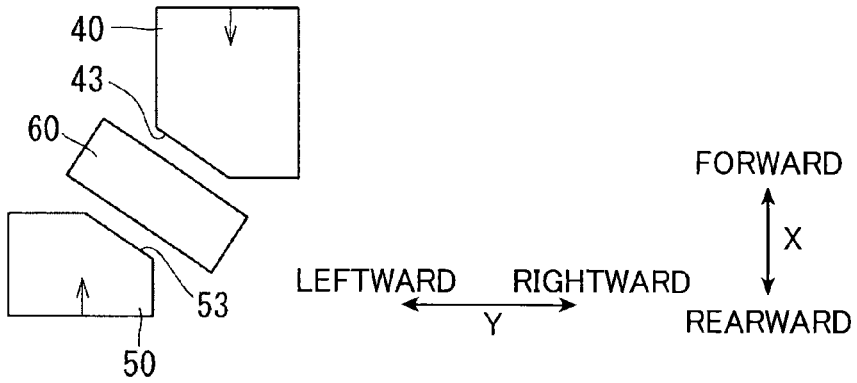
Figure 3C:
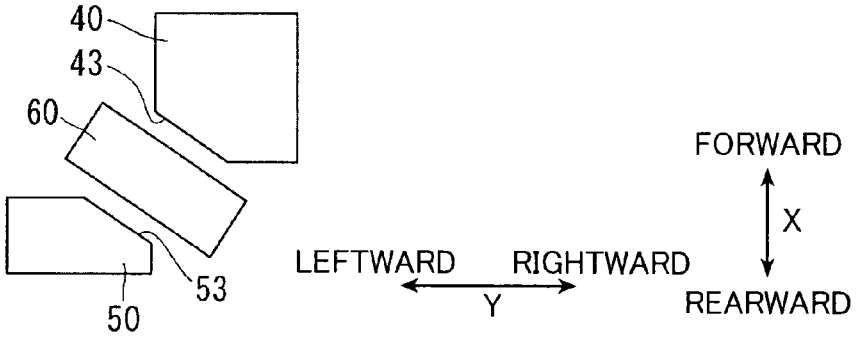

The fuel tank 40 and the hydraulic fluid tank 50 can be disposed so as to prevent the front opposition side surface 43 and the rear opposition side surface 53 from being excessively large, in order to secure sufficient capacities of the fuel tank 40 and the hydraulic fluid tank 50. Specifically, the hydraulic fluid tank 50 depicted in FIG. 1 and FIG. 2 is disposed so as to be offset from the fuel tank 40 in the frame lateral direction. In other words, the fuel tank 40 is disposed so as to create "offset" from the hydraulic fluid tank 50 in the frame lateral direction. The direction of the "offset" of the hydraulic fluid tank 50 from the fuel tank 40 in the frame lateral direction is inward (leftward). The direction of the "offset" is such a direction that the required length of the rear opposition side surface 53 as viewed from above decreases with increase in magnitude of the "offset", as depicted in FIG. 3A and FIG. 3B.

As depicted in FIG. 1, the fuel tank 40 and the hydraulic fluid tank 50 are disposed so as to meet the following condition T1 and so as to meet at least one of the conditions T2 and T3.

The condition T1: The center of the hydraulic fluid tank 50 in the frame lateral direction (the line 50*a* passing through the center) is offset inward from the center of the fuel tank 40 in the frame lateral direction (from the line 40*a* passing through the center). The line 40*a* is a straight line extending in the frame front-rear direction through a midpoint of a segment joining the inner side surface 41N and outer side surface 41T of the fuel tank 40 to each other in the frame lateral direction.

The condition T2: At least a part of the hydraulic fluid tank 50 is located inward of the inner side surface 41N of the fuel tank 40, that is, protrudes inward in the frame lateral direction.

The condition T3: At least a part of the fuel tank 40 is located outward of the outer side surface 51T of the hydraulic fluid tank 50, that is, protrudes outward beyond the outer side surface 51T.

The fuel tank 40 includes a portion protruding outward beyond the outer end portion of the control valve 60 (the front end of the outer end surface 67 in FIG. 1) in the frame lateral direction. The hydraulic hoses 71 are routed so as to be aligned with the protruding portion in the frame front-rear direction.

The above-described upper slewing body 1 exerts the following effects.

(1) The location of the control valve 60 rearward of the slewing axis allows the hydraulic hoses 71 to have a reduced length compared to an arrangement of locating the control valve 60 forward of the slewing axis. Although this rearward disposition of the control valve 60 reduces the distance between the control valve 60 and the engine 31 in the frame front-rear direction, the oblique disposition of the control valve 60 wherein the inner end portion thereof is forward of the outer end portion of the control valve 60 enables the enlarged space S1 (FIG. 2) to be created, thus allowing the hydraulic fluid tank 50 to be disposed in the space S1. The hydraulic fluid tank 50, namely, the rear tank, is thus allowed to be disposed by effective utilization of a narrow space between the control valve 60 and the engine 31. In summary, in spite of the location of the control valve 60 rearward of the slewing axis, the hydraulic fluid tank 50 can be disposed between the control valve 60 and the engine 31. In other words, even though the hydraulic fluid tank 50 is interposed between the control valve 60 and the engine 31, it is possible to bring the outer end portion of the control valve 60 near the hydraulic pump 33 coupled to the engine 31 to thereby enable the required lengths of the hydraulic hoses 71 to be reduced.

(2) The hydraulic fluid tank 50, including the rear opposition side surface 53 opposed to the rear side surface 63R while being oblique in the same direction as that in which the rear side surface 63R of the control valve 60 is oblique (preferably being parallel to the rear side surface 63R), allows the space required for alignment of the control valve 60 and the hydraulic fluid tank 50 with each other in the frame front-rear direction to be reduced in the dimension in the frame front-rear direction, in spite of the obliquity of the control valve 60. In addition, the disposition facilitates routing the hydraulic hoses 71 and 73 and finding the space for the routing between the control valve 60 and the rear opposition side surface 53.

(3) The inward offset of the hydraulic fluid tank 50 from the control valve 60 in the frame lateral direction facilitates finding the space S2 for routing of the hydraulic hoses 71 on the outer side of the hydraulic fluid tank 50, and the like.

(4) The hydraulic fluid tank 50, disposed across over the right vertical plate 17R, that is, one closer to the control valve 60 in the frame lateral direction of the right and left vertical plates 17R and 17L, can be disposed between the control valve 60 and the engine 31 with a sufficient capacity thereof, in spite of the presence of the right vertical plate 17R.

(5) The fuel tank 40, including the front opposition side surface 43 opposed to the front side surface 63F of the control valve 60 while being oblique in the same direction as that in which the front side surface 63F is oblique (preferably being parallel to the front side surface 63F), allows the space required for alignment of the control valve 60 and the fuel tank 40 with each other in the frame front-rear direction to be reduced in the dimension in the frame front-rear direction, in spite of the obliquity of the control valve 60. In addition, the disposition facilitates routing the hydraulic hoses 73 or 71 and finding the space for the routing between the control valve 60 and the front opposition side surface 43.

(6) As described above, the control valve 60, disposed between the rear opposition side surface 53 and the front opposition side surface 43 which are oblique to the frame lateral direction in association with the rear side surface 63R and the front side surface 63F, enables the control valve 60, the fuel tank 40 and the hydraulic fluid tank 50 to be compactly arranged, even though the control valve 60 itself is oblique to the frame lateral direction. Specifically, it is possible to reduce the distance in the frame-front-rear direction from the rear side surface 41R of the fuel tank 40 to the front side surface 51F of the hydraulic fluid tank 50. Moreover, it can be easily performed to find the space for routing the hydraulic hoses 71 and 73 between the control valve 60 and the rear opposition side surface 53 and between the control valve 60 and the front opposition side surface 43.

(7) The offset of the hydraulic fluid tank 50 from the fuel tank 40 in the frame lateral direction makes it possible to perform at least one of the following: (7A) increasing the capacity of at least one of the tanks 50 and 40; and (7B) realizing compact arrangement, compared to an arrangement without the offset, that is, an arrangement of aligning the tanks 50 and 40 with each other in the frame front-rear direction. The detail is as follows.

(7A) Tank Capacity: Shifting the position of the hydraulic fluid tank 50 relative to the control valve 60 in the frame lateral direction inward decreases the required horizontal length of the rear opposition side surface 53. Hence, given that the hydraulic fluid tank 50 has specific dimensions in the frame lateral direction and in the frame front-rear direction, the capacity of the hydraulic fluid tank 50 can be increased by an amount equal to the reduction in the area of the rear opposition side surface 53. Similarly, as the position of the fuel tank 40 relative to the control valve 60 in the frame lateral direction is biased more outward, the required horizontal length of the front opposition side surface 43 is decreased. Hence, given that the fuel tank 40 has specific dimensions in the frame lateral direction and in the frame front-rear direction, the capacity of the fuel tank 40 is increased by an amount equal to the reduction in the area of the front opposition side surface 43. The "offset" of the tanks 50 and 40 in the frame lateral direction, thus, enables the capacity of at least one of the tanks 50 and 40 to be increased.

(7B) Compact Arrangement: Given that the hydraulic fluid tank 50 has a specific dimension in the frame lateral direction, the reduction in the size of the rear opposition side surface 53 allows the hydraulic fluid tank 50 to have a reduced size in the front-rear direction while keeping its capacity. Similarly, given that the fuel tank 40 has a specific dimension in the frame lateral direction, the reduction in the size of the front opposition side surface 43 allows the fuel tank 40 to have a reduced size in the frame front-rear direction while keeping its capacity.

The present invention is not limited to the above-described embodiment. For example, the "front tank" according to the present invention can be omitted. Furthermore, the "rear tank" and the "front tank" are not limited to the hydraulic fluid tank 50 and the fuel tank 40, respectively. For example, the rear tank may be a fuel tank and the front tank may be a hydraulic fluid tank.

As described above, there can be provided an upper slewing body including an upper frame, an engine, a hydraulic pump coupled to the engine, a control valve connected to the hydraulic pump via a hydraulic pipe, and a tank, the upper slewing body allowing the elements to be compactly arranged on the upper frame while suppressing an increase in the required length of the hydraulic pipe. Provided is an upper slewing body mounted on a lower traveling body of a construction machine, the upper slewing body including: an upper frame mounted on the lower traveling body so as to be able to be slewed around a slewing axis; an engine mounted in the upper frame at a position rearward of the slewing axis in a frame front-rear direction that is a front-rear direction of the upper frame; a hydraulic pump coupled to one of opposite end portions of the engine in a frame lateral direction to be driven by the engine, the frame lateral direction being a lateral direction of the upper frame; a control valve mounted on the upper frame at a position rearward of the slewing axis and forward of the engine in the frame front-rear direction; a hydraulic pipe interconnecting the hydraulic pump and the control valve; and a rear tank mounted on the upper frame at a position between the engine and the control valve with respect to the frame front-rear direction. The control valve has an inner end portion and an outer end portion which are two opposite end portions in the frame lateral direction, the inner end portion being closer to the slewing axis than the outer end portion. The control valve is disposed so as to locate the outer end portion on the same side as the hydraulic pump, relative to the slewing axis, in the frame lateral direction. The control valve is mounted on the upper frame obliquely to the frame lateral direction so as to locate the outer end portion rearward of the inner end portion in the frame front-rear direction. The hydraulic pipe connects the hydraulic pump to a connection portion of the control valve, the connection portion being closer to the outer end portion than the inner end portion. The rear tank includes an overlap portion overlapping the control valve as viewed in the frame front-rear direction. The overlap portion has a rear opposition side surface oblique to the frame lateral direction in the same direction as a direction in which a rear side surface of the control valve is oblique, the rear opposition side surface being opposed to the rear side surface.

In the upper slewing body, the control valve, disposed rearward of the slewing axis and forward of the engine and being oblique to the frame lateral direction in such a direction that the outer end portion of the control valve is rearward of the inner end portion of the control valve, enables the required length of the hydraulic pipe connecting the control valve to the hydraulic pump coupled to the engine to be reduced. Moreover, the rear tank, having a rear opposition side surface which is a side surface opposed to the rear side surface of the control valve while being oblique to the frame lateral direction in the same direction as that in which the rear side surface of the control valve is oblique, allows the distance from the control valve to the engine in the frame front-rear direction to be prevented from increase, that is, allows the elements to be compactly arranged, in spite of the interposition of the rear tank between the control valve and the engine.

Specifically, the rear tank preferably has a shape in a top plan view, the shape being a remainder of a rectangle from which a specific corner portion thereof has been cut out along the rear opposition side surface, the rectangle extending in the frame lateral direction, the specific corner portion being closest to the control valve of four corner portions of the rectangle. This shape can give an increased capacity to the rear tank while securing the above-described compact arrangement.

The rear tank is preferably located inward of the control valve in the frame lateral direction. This offset of the rear tank from the control valve in the frame lateral direction makes it possible to reduce the required horizontal length of the rear opposition side surface to thereby increase the capacity of the rear tank.

In this arrangement, the outer end portion of the control valve can be aligned with the hydraulic pump in the frame front-rear direction, and the hydraulic pipe is routed between the control valve and the hydraulic pump in a region on the outer side of the rear tank in the frame lateral direction.

The upper frame may include a bottom portion, a right vertical plate and a left vertical plate, the right and left vertical plates arranged in juxtaposition to each other in the frame lateral direction, in a central region of the upper frame with respect to the frame lateral direction, each of the right and left vertical plates extending in the frame front-rear direction and projecting upward beyond the bottom portion. On this upper frame, the rear tank can be disposed across over one plate of the right and left vertical plates, the one plate being closer to the control valve, in the frame lateral direction; this allows the rear tank to be disposed between the control valve and the engine while having a large capacity, in spite of the presence of the vertical plates.

The upper slewing body may further include a front tank mounted on the upper frame at a position forward of the control valve in the frame front-rear direction. The front tank, preferably, includes an overlap portion overlapping the control valve as viewed in the frame front-rear direction, the overlap portion including a front opposition side surface opposed to a front side surface of the control valve while being oblique to the frame lateral direction in the same direction as that in which the control valve is oblique. The front opposition side surface allows a space required for aligning the front tank and the control valve with each other in the frame front-rear direction to be prevented from increase with respect to the dimension in the frame front-rear direction, in spite of the obliquity of the control valve to the frame lateral direction.

Specifically, the front tank preferably has a shape in a top plan view, the shape being a remainder of a rectangle from which a specific corner portion thereof has been cut out along the front opposition side surface, the rectangle extending in the frame lateral direction, the specific corner portion being closest to the control valve of four corner portions of the rectangle. This shape can give an increased capacity to the front tank while securing the above-described compact arrangement.

Preferably, the front tank includes a protruding portion which protrudes outward beyond the outer end portion of the control valve in the frame lateral direction, the hydraulic pipe being routed so as to be aligned with the protruding portion in the frame front-rear direction. This disposition, shifting the position of the front tank relative to the control valve outward, enables the hydraulic pipe to be routed without an increase in the dimension of the upper frame in the frame lateral direction, while reducing the required length of the front opposition side surface of the front tank to increase the capacity of the tank.

This application is based on Japanese Patent application No. 2014-058535 filed in Japan Patent Office on Mar. 20, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An upper slewing body mounted on a lower traveling body of a construction machine, the upper slewing body comprising:

an upper frame mounted on the lower traveling body so as to be able to be slewed around a slewing axis;

an engine mounted in the upper frame at a position rearward of the slewing axis in a frame front-rear direction that is a front-rear direction of the upper frame;

a hydraulic pump coupled to one of opposite end portions of the engine in a frame lateral direction to be driven by the engine, the frame lateral direction being a lateral direction of the upper frame;

a control valve mounted on the upper frame at a position rearward of the slewing axis and forward of the engine in the frame front-rear direction;

a hydraulic pipe interconnecting the hydraulic pump and the control valve; and a rear tank mounted on the upper frame at a position between the engine and the control valve with respect to the frame front-rear direction, wherein:

the control valve has an inner end portion and an outer end portion which are two opposite end portions in the frame lateral direction, the inner end portion being closer to the slewing axis than the outer end portion;

the control valve is disposed so as to locate the outer end portion on the same side as the hydraulic pump, relative to the slewing axis, in the frame lateral direction;

the control valve is mounted on the upper frame obliquely to the frame lateral direction so as to locate the outer end portion rearward of the inner end portion in the frame front-rear direction;

the hydraulic pipe connects the hydraulic pump to a connection portion of the control valve, the connection portion being closer to the outer end portion than the inner end portion; and the rear tank includes an overlap portion overlapping the control valve as viewed in the frame front-rear direction, the overlap portion including a rear opposition side surface oblique to the frame lateral direction in the same direction as a direction in which a rear side surface of the control valve is oblique, the rear opposition side surface being opposed to the rear side surface.

2. The upper slewing body according to claim 1, wherein the rear tank has a shape in a top plan view, the shape being a remainder of a rectangle from which a specific corner portion thereof has been cut out along the rear opposition side surface, the rectangle extending in the frame lateral direction, the specific corner portion being closest to the control valve of four corner portions of the rectangle.

3. The upper slewing body according to claim 1, wherein the rear tank is located inward of the control valve in the frame lateral direction.

4. The upper slewing body according to claim 3, wherein the outer end portion of the control valve is aligned with the hydraulic pump in the frame front-rear direction, and the hydraulic pipe is routed between the control valve and the hydraulic pump in a region on the outer side of the rear tank in the frame lateral direction.

5. The upper slewing body according to claim 1, wherein the upper frame includes a bottom portion, a right vertical plate and a left vertical plate, the right and left vertical plates arranged in juxtaposition to each other in the frame lateral direction, in a central region of the upper frame with respect to the frame lateral direction, each of the right and left vertical plates extending in the frame front-rear direction and projecting upward beyond the bottom portion, and the rear tank is disposed across over one plate of the right and left vertical plates, the one plate being closer to the control valve, in the frame lateral direction.

6. The upper slewing body according to claim 1, further comprising a front tank mounted on the upper frame at a position forward of the control valve in the frame front-rear direction, the front tank including an overlap portion overlapping the control valve as viewed in the frame front-rear direction, the overlap portion including a front opposition side surface opposed to a front side surface of the control valve while being oblique to the frame lateral direction in the same direction as a direction in which the control valve is oblique.

7. The upper slewing body according to claim 6, wherein the front tank has a shape in a top plan view, the shape being a remainder of a rectangle from which a specific corner portion thereof has been cut out along the from opposition side surface, the rectangle extending in the frame lateral direction, the specific corner portion being closest to the control valve of four corner portions of the rectangle.

8. The upper slewing body according to claim 6, wherein the front tank includes a protruding portion which protrudes outward beyond the outer end portion of the control valve in the frame lateral direction, and the hydraulic pipe is routed so as to be aligned with the protruding portion in the frame front-rear direction.

* * * * *